US008636448B2

(12) United States Patent
Hill, III et al.

(10) Patent No.: US 8,636,448 B2
(45) Date of Patent: Jan. 28, 2014

(54) DRILLING APPARATUS, METHOD, AND SYSTEM

(75) Inventors: John L. Hill, III, Woodbridge, VA (US); Mike Brennan, Bristow, VA (US); Joram Shenhar, Fairfax, VA (US); David Koch, Fredericksburg, VA (US); Mark Lombardo, Arlington, VA (US); Benjamin Dolgin, Newington, VA (US); Luis Giraldo, Fairfax, VA (US)

(73) Assignee: Raytheon Company, Waltham, MA (US)

( * ) Notice: Subject to any disclaimer, the term of this patent is extended or adjusted under 35 U.S.C. 154(b) by 1166 days.

(21) Appl. No.: 11/501,826

(22) Filed: Aug. 10, 2006

(65) Prior Publication Data

US 2006/0266556 A1 Nov. 30, 2006

Related U.S. Application Data

(63) Continuation of application No. 10/919,271, filed on Aug. 17, 2004, now abandoned.

(60) Provisional application No. 60/496,379, filed on Aug. 20, 2003.

(51) Int. Cl.
*E21B 17/22* (2006.01)

(52) U.S. Cl.
USPC ..... 405/259.5; 411/82

(58) Field of Classification Search
USPC ..... 405/259.1, 259.5
See application file for complete search history.

(56) References Cited

U.S. PATENT DOCUMENTS

| | | | | | |
|---|---|---|---|---|---|
| 1,791,368 | A | * | 2/1931 | Mullett | 52/157 |
| 1,940,938 | A | * | 12/1933 | Chance | 52/157 |
| 3,662,436 | A | * | 5/1972 | Roza | 24/115 R |
| 3,793,786 | A | * | 2/1974 | Jahnke | 52/157 |
| 4,037,373 | A | * | 7/1977 | Echtler | 52/127.5 |
| 4,161,132 | A | | 7/1979 | Eklund et al. | |
| 4,501,515 | A | * | 2/1985 | Scott | 405/259.3 |
| 4,659,258 | A | * | 4/1987 | Scott | 405/259.6 |
| 5,433,558 | A | | 7/1995 | Gray | |
| 5,575,593 | A | * | 11/1996 | Raaf | 405/237 |
| 5,641,027 | A | | 6/1997 | Foster | 175/107 |
| 5,957,646 | A | * | 9/1999 | Giannuzzi et al. | 411/412 |
| 6,058,662 | A | * | 5/2000 | Perko | 52/157 |
| 6,176,638 | B1 | * | 1/2001 | Kellison et al. | 403/268 |
| 6,309,159 | B1 | * | 10/2001 | Weaver et al. | 411/387.5 |
| 6,619,899 | B1 | * | 9/2003 | Gaudron | 411/386 |
| 6,824,331 | B2 | * | 11/2004 | Parker | 405/259.1 |
| 7,076,924 | B2 | * | 7/2006 | Thompson | 52/100 |
| 2003/0026664 | A1 | | 2/2003 | Mongrain | 405/259.1 |

FOREIGN PATENT DOCUMENTS

| | | | |
|---|---|---|---|
| DE | 3219356 | A | 12/1983 |
| EP | 1 277 887 | A2 | 1/2003 |
| GB | 1506868 | A | 4/1978 |
| RU | 846744 | | 10/1979 |
| RU | 2081331 | C1 | 6/1997 |
| SU | 418608 | A1 | 3/1974 |
| SU | 878954 | A2 | 11/1981 |
| SU | 1465594 | A1 | 3/1989 |

* cited by examiner

*Primary Examiner* — Tara M. Pinnock
(74) *Attorney, Agent, or Firm* — Cantor Colburn LLP

(57) ABSTRACT

A method of supporting a substrate includes inserting a rock bolt into a hole and using the rock bolt to form a groove in a wall of the hole when the rock bolt is inserted therein. The rock bolt is caused to interact with the groove in such a way that the rock bolt is secured in the hole at least in part by the interaction.

21 Claims, 21 Drawing Sheets

DRILLING APPARATUS, METHOD, AND SYSTEM

This is a continuation of U.S. patent application Ser. No. 10/919,271, filed Aug. 17, 2004, now abandoned, which claims the benefit of U.S. Provisional Patent Application No. 60/496,379, filed Aug. 20, 2003, now abandoned. The entire disclosures of U.S. patent application Ser. No. 10/919,271 and U.S. Provisional Patent Application No. 60/496,379 are incorporated herein by reference.

BACKGROUND

1. Field of the Invention

The invention relates to helical drag bits and rock bolt systems, which can be used for geotech, mining, and excavation purposes. The invention also relates to methods of using such helical drag bits, and systems incorporating such helical drag bits and rock bolts.

2. Related Art

Known drilling systems may employ roller cone bits, which operate by successively crushing rock at the base of a bore. Roller cone bits are disadvantageous because rock is typically resistant to crushing. Other known rock drilling systems employ drag bits. Conventional drag bits operate by shearing rock off at the base of the bore. Drag bits can be more efficient than roller cone bits because rock is typically less resistant to shearing than to crushing.

Most state of the art rock cutting processes are accomplished by the shearing action or grinding motion of some cutting tool. These cutting actions result in a noisy work environment coupled with the undesirable excitation vibrations that are transmitted to the drill unit home structure. A parameter of paramount importance in any drilling process is the "weight-on-bit" which is the axial force acting on the bit during the cutting process. Normally this force is relatively large and may be generated via proper anchoring of the drill machine to the drilled surface or as an alternative, weight-on-bit may be provided by the self-weight of the drill unit structure.

U.S. Pat. No. 5,641,027 to Foster ("the '027 patent"; assigned to UTD Incorporated) discloses a drilling system incorporating a bit with thread cutting members arranged in a helical pattern. Each subsequent cutting member is wedge shaped such that the threads cut by the bit are fragmented, i.e., snapped off. The bit disclosed by the '027 patent is suitable for enlarging a bore formed by a pilot drill bit. The entirety of the '027 patent is hereby incorporated by reference herein.

A Low Reaction Force Drill (LRFD), such as that disclosed in the '027 patent, is a low-energy, low mass, self-advancing drilling system. Energy expenditures have been demonstrated by studies to be at least five times less than other prior art systems suitable for similar drilling purposes. The distinct advantages of the LRFD are its low energy drilling capability as a function of its unique rock cutting mechanism, its essentially unlimited depth capability due to its tethered downhole motor and bailing bucket configuration, its self-advancing capability by self-contained torque and weight-on-bit by counteracting multiple concentric rock cutters and bracing against rock or regolith. Additional LRFD advantages may be found in its large non-thermally degraded intact sample production (>1 $cm^3$) with position known to within 15 mm, and finally, the large diameter hole it produces that allows for down hole instrumentation during and post drilling. The system has application for shallow drilling (1 to 200 meters) through kilometer class drilling in a broad range of materials. It would be advantageous to utilize the advantages of this system in a new drag bit geometry, while also mitigating disadvantageous characteristics of this system with a new bit.

It would be advantageous to have a helical drag bit that utilizes fewer power resources and that can operate with or without fluid lubrication. It would also be advantageous if such a drag bit could operate under extreme cold and near vacuum conditions, such as those found at extra-terrestrial sites.

A problem encountered by geologists or other rock mechanics investigators is the difficulty of obtaining accurate compressive strength measurements of rock in the field, particularly in situ during drilling. In conventional drilling, several drilling variables must be simultaneously monitored in order to interpret lithologic changes, including thrust, rotational velocity, torque, and penetration rate. This is true because with each conventional bit rotation the amount of material removed is a function of all of those variables. It would be advantageous for a geo-technical system to enable geologists and others to obtain accurate substrate characteristic measurements in situ.

In the mining industry, roof falls in coal mines continue to be the greatest safety hazard faced by underground coal mine personnel. The primary support technique used to stabilize rock against such events in coal and hard rock mines are rock bolts or cable bolts. Both of these primary support techniques involve drilling holes in rock and establishing anchoring in those holes. Current fatality and injury records underscore the need to improve these operations.

As the primary means of rock reinforcement against roof collapse, rock bolts play an important role. As collected from rock bolt manufacturers by NIOSH (i.e., the National Institute for Occupational Safety and Health), approximately 100 million rock bolts were used in the U.S. mining industry in 1999 and of those, approximately 80% used grout as a means of anchoring the bolt to the rock (up from approximately 48% in 1991) with the vast majority of the remaining percentage of rock bolts using mechanical anchors. Cuts through mountainous terrains by highways and railways also extensively use rock bolts or cable bolts for rock mass stabilization.

While a broad range of anchoring techniques have been developed, grouting and mechanical expansion anchor bolts are the more common, together comprising over 99% of rock bolts used in coal mines in the U.S. The decline in the use of mechanical bolts is attributed to the fact that grouted rock bolts distribute their anchoring load on the rock over a greater area and generally produce better holding characteristics.

As a major contributor to a roof control plan, rock bolts have been studied to determine optimum installation spacing, length, and matching of anchoring with geologic conditions. The main ways rock bolts support mine roofs are typically described as follows: beam building (the tying together of multiple rock beams so they perform as a larger single beam), suspension of weak fractured ground to more competent layers, pressure arch, and support of discrete blocks. Cable bolting (where cables are used in place of steel rods as bolts) performs similar functions. While rock bolts play a critical role in mitigating rock mass failure, many other mine design factors come into play to create a stable mine environment including (but not limited to) opening dimensions, sequence of excavation, matching of bolt anchor and length with opening and geologic conditions, and installation timing. Notwithstanding the importance of these other factors, if the rock bolts used in rock stabilization do not perform well, miners are at risk.

Bolt installation characteristics near roof falls have been identified as contributing to failure. One documented and regularly occurring rock bolt failure mechanism is loss of grout shear bond to the rock wall of the bolt hole. Key contributors to the integrity of the grout interlocking with the rock mass are the diameter of the hole relative to the diameter of the bolt, resin vs. cement type grouts, rock type and condition of the hole.

Smooth bolt holes consistently produce a reduction in rock bolt load bearing capacity over rough walled holes. To address this, bolt hole bit manufacturers intentionally use reduced tolerances in their manufacturing on the center of bit peaks, and setting of bit cutter inserts in such a way as to induce a wobble during drilling, as well as loose bit mounting to drill rod, with the ultimate result of ridges being left on hole walls. The approach generally produces increased anchoring capacity. However, even with these variations in bolt hole smoothness, anchorage capacity increases, but failure of the rock-grout interface is still common.

While considerable research into rock bolting has been conducted to date, gaps still exist in areas that could lead to vast improvements in rock bolt performance. For example, significant pull-test studies have been performed and optimal hole diameter to bolt diameter ratios have been identified for maximum anchorage capacity, and hole condition has been identified as an important contributor to ultimate holding capacity. A relatively unexplored feature in rock bolt holding capacity is hole geometry. It would be advantageous to optimize bolt hole geometry for improved holding capacity.

Other problems are also encountered in the field of rock bolt hole drilling: dust and noise. During most rock bolt drilling operations, the operator stands directly at the controls, a couple of feet away from the machinery and the actual drilling process. Research by NIOSH has identified potential for high silica dust levels around roof bolters in coal mines and attributes much of the cause to the vacuum collection and filtering of air used in the drilling process. While significant research into dust hazards and health effects has been conducted by NIOSH (and previously by the U.S. Department of Interior, Bureau of Mines), the measures to improve the environment for rock bolt drillers has been limited almost entirely to worker protection actions.

Noise near mining machinery has also been studied. Engineering solutions to the mitigation of high noise levels are always preferred over administrative solutions or personal protective equipment. The key is to make those engineering solutions cost-effective.

Similarly, dust protective equipment is useful, but low-dust-by-design solutions offer greater opportunity for seamless incorporation and effectiveness in improving the safety and health environment for miners.

SUMMARY

The invention relates to novel helical drag bits as well as to systems incorporating such helical drag bits and to methods of using them. The invention overcomes to a substantial extent the disadvantages of the prior art. Thus, according to one aspect of the invention, the helical drag bits incorporate one or more spirally/helically positioned cutting arms of increasing radial length as they are positioned in a direction moving away from the tip-end of the drag bit. The cutting arms can create a spiral trench geometry in the sidewall of a predrilled pilot hole.

In an alternative embodiment, the cutting arms terminate in scoring cutting blades. These blades serve to cut a relatively smooth pilot hole bore extension into the sidewalls of the hole, thereby enlarging the hole diameter. The cutting arms of this embodiment can be used with those of the previous embodiment without the scoring blades or may be used by themselves.

The embodiments of the helical drag bit can be incorporated into a system and method for measuring geo-tech characteristics of drilled substrates. The measurements can be made in situ during drilling.

The helical drag bit can be used in a system and method for improving the holding capacity of rock bolts and similar devices for use in the mining industry or in any circumstances where a particulate substrate may benefit from support. The helical drag bit can produce an improved rock bolt hole geometry, which can interact with mechanical or chemical holding means to improve pull-out capacity in the support structure. Conventional as well as novel rock bolts (having new structures) can be used with this improved hole geometry. Such novel rock bolts can incorporate the helical drag bit design or can excavate a rock bolt hole in a similar way.

The above-discussed as well as other advantages can be better understood from the detailed discussion below in view of the accompanying figures referred to therein.

DETAILED DESCRIPTION

The invention relates to helical drag bits, systems incorporating the bits, and to methods of using the bits and systems. Throughout this detailed description, the terms "helical drag bit" and "helicutter" are used interchangeably. The term "flight" indicates a portion of a segmented bit shaft, which comprises cutting arms. The term "cutting arm" is interchangeable with "cutter." The terms "resin" and "grout" are also used interchangeably.

The helical drag bits of the invention provide an advancement mechanism that move cutters along the circumference of a pilot hole, such as a pilot rock bolt hole. Simultaneously, the bit advances the cutter along the length of the pilot hole, thereby introducing machined grooves into the walls of the pilot hole. The rates of cutter movement along the circumference and length of the pilot hole may be varied independently to produce a variety of geometries, including evenly and unevenly spaced grooves.

Figure 1A:
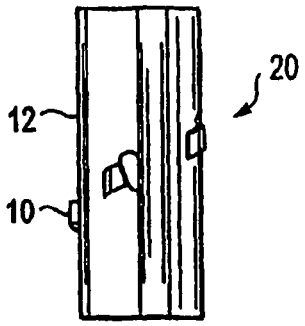
FIGS. 1*a* and 1*b* are views of a helical drag bit flight portion in accordance with an embodiment of the invention.
Figure 1B:
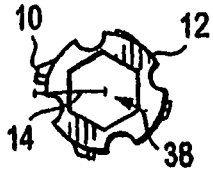
Figure 2A:
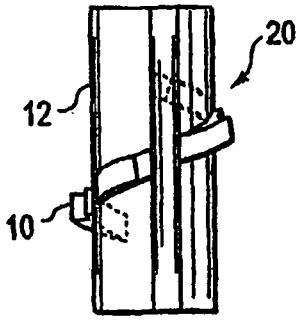
FIGS. 2*a* and 2*b* are views of a helical drag bit flight portion in accordance with an embodiment of the invention.
Figure 2B:
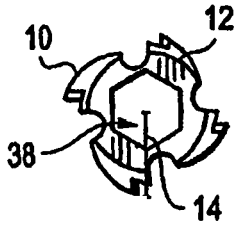

Two exemplary embodiments of helical drag bits in accordance with the invention have spirally/helically positioned cutting arms 10 that are spaced apart over the outer surface of a bit shaft 12, as shown in FIGS. 1*a*, 1*b*, 2*a*, and 2*b*. FIG. 1*b* shows the bit flight 20 of FIG. 1*a* from a top view and FIG. 2*b* shows the bit flight 20 of FIG. 2*a* from a top view. These figures show bit flights 20 having cutting arms 10 that extend away from the bit shaft 12 with a radial length 14 (measured from the center of rotation) for each arm 10. The radial length 14 generally corresponds to the cutting depth of the individual arms 10. The radial length 14 of the arms 10 can increase, as shown in FIG. 2*b* (and FIG. 8), with each individual arm 10 from a bottom arm 10*a* to a top arm 10*b* so that each successive arm 10 has a deeper cutting depth in a direction moving away from the tip-end 16 of the bit shaft 12 (see FIG. 8).

Figure 3A:
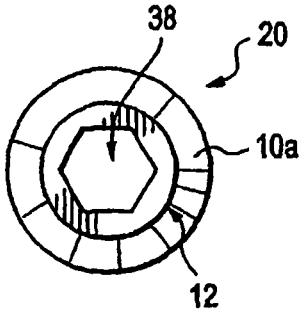
FIGS. 3*a* and 3*b* are views of a helical drag bit flight portions during fabrication in accordance with an embodiment of the invention.
Figure 3B:
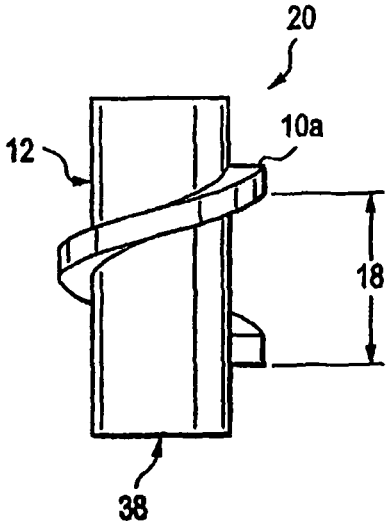
Figure 7:
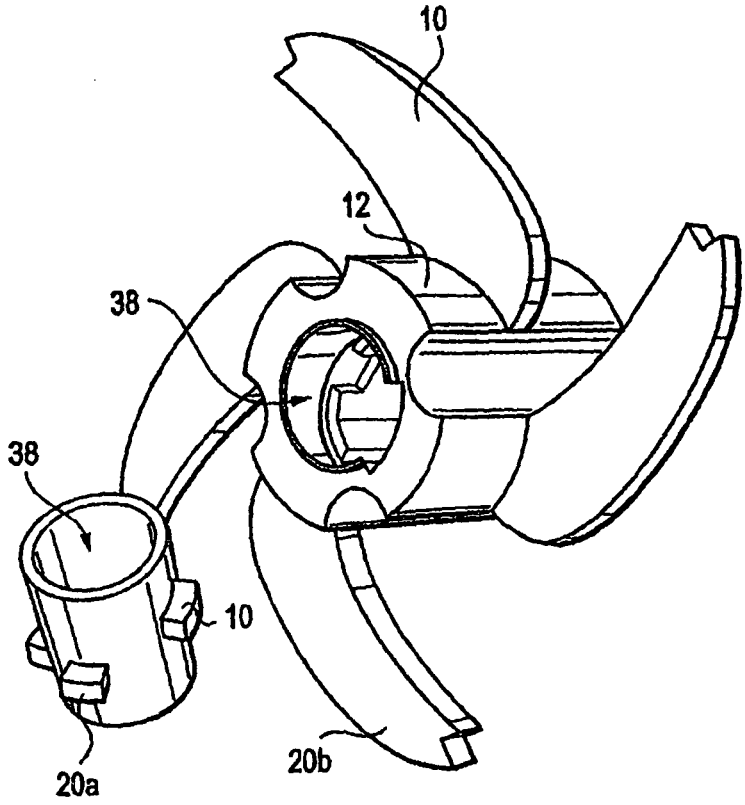
FIG. 7 is a view of two helical drag bit flight portions in accordance with an embodiment of the invention.
Figure 8:
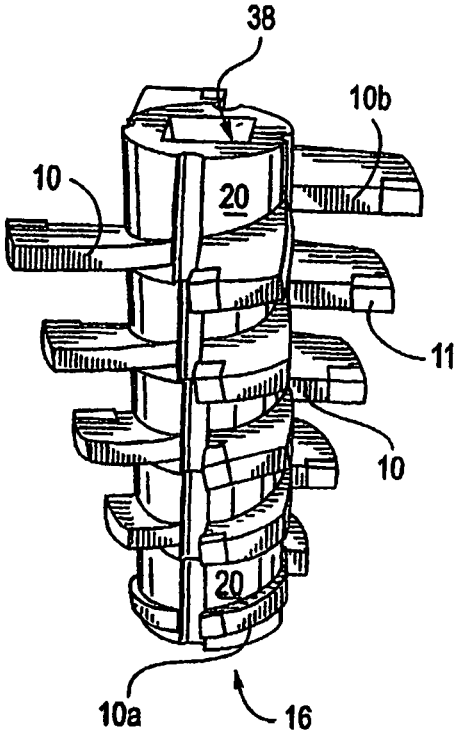
FIG. 8 is a view of a stack of helical drag bit flight portions in accordance with an embodiment of the invention.

As shown in FIGS. 3*a* and 3*b*, which depict top and side views of an exemplary bit flight 20 during fabrication of the cutting arms 10, the arms 10 are designed to track in a spiral manner, having a uniform axial pitch 18 following a consistent spiral track, similar to a self-starting thread tap. Bit flights 20 are fabricated with a hub 38, which is used during operation of the bit system to stack bit flights 20 and turn the stacked flights 20. The hub 38 may be any suitable shape, but is preferably round with hexagonally formed borehole. Bit flights 20 may initially be fabricated with a continuous spiraling thread 10*a*, which is later machined to shape individual cutting arms 10 of a selected radial length 14 and geometry. Various cutting arm 10 geometries are within the scope of the invention, as shown in FIGS. 1*a*-2*b* and 6-8. As shown in FIG. 8, the basic flight members 20 of the bit can be stacked with additional flights 20 also having cutting arms 10 of an ever-increasing radial length 14 in a direction away from the tip-end 16. In this way, a maximum desired cutting depth can be achieved in a low energy bit.

Figure 4A:
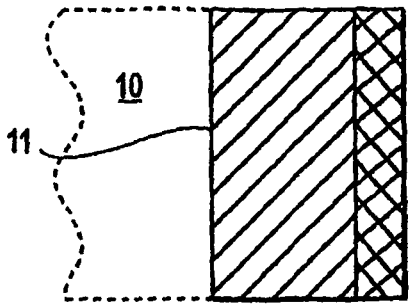
FIGS. 4*a* and 4*b* are views of cutting arm inserts in accordance with an embodiment of the invention.
Figure 4B:
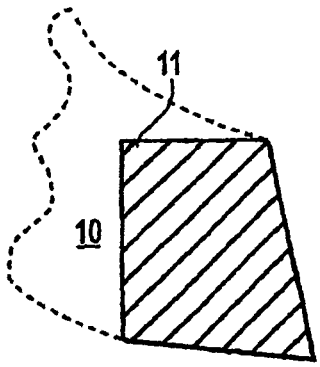
Figure 5A:
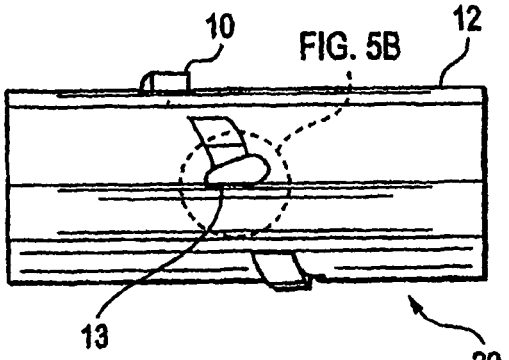
FIGS. 5*a* and 5*b* are views of a helical drag bit flight portion in accordance with an embodiment of the invention, with FIG. 5*b* being a detail of a portion of the view shown in FIG. 5*a;*
Figure 5B:
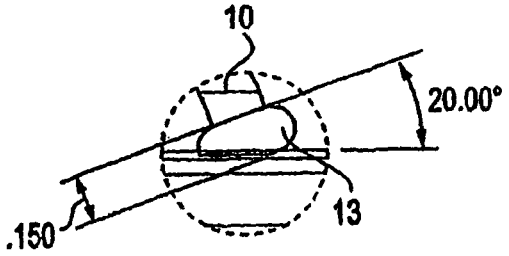
Figure 9:
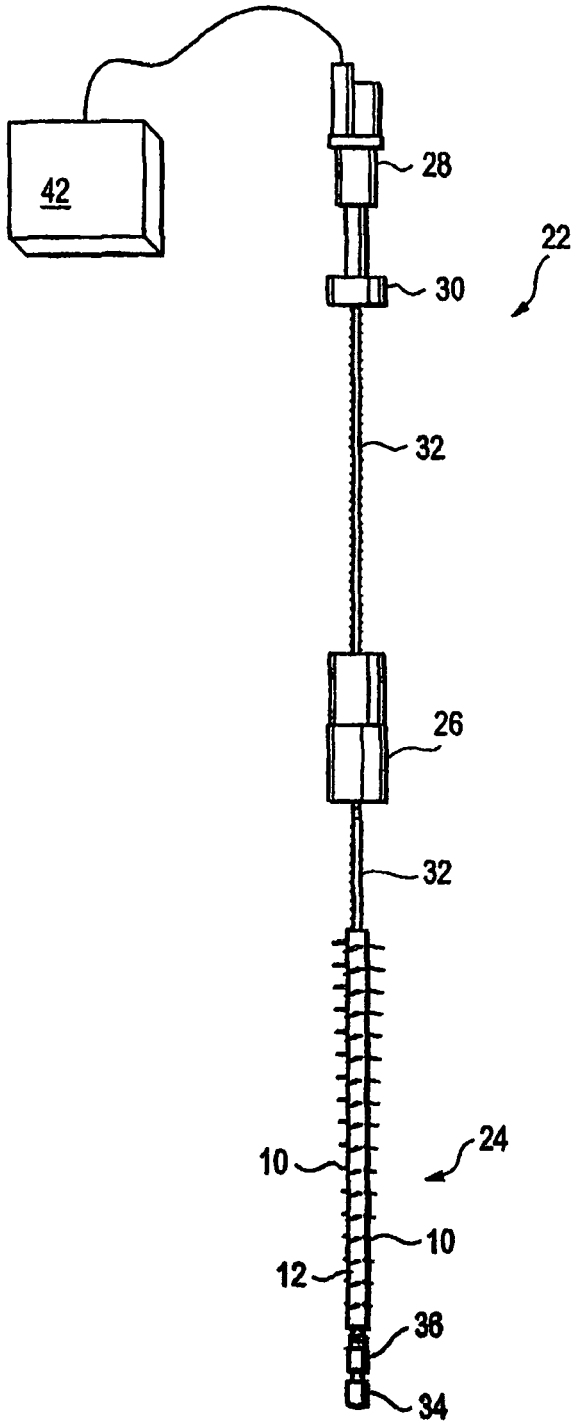
FIG. 9 is a view of a drilling system incorporating a helical drag bit in accordance with an embodiment of the invention.
Figure 10A:
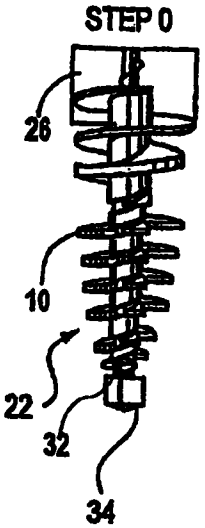
FIGS. 10(*a*) through 10(*e*) show the drilling system of FIG. 9, shown in sequential drilling steps 0-4 in accordance with an embodiment of the invention.
Figure 10B:
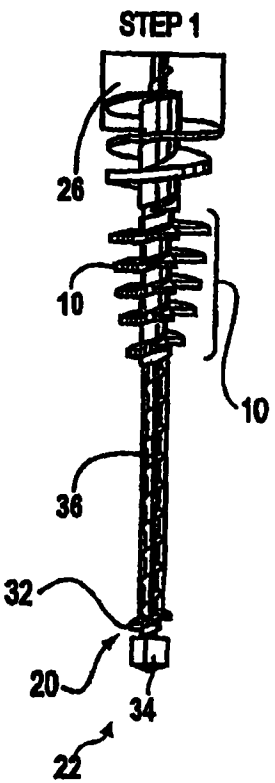
Figure 10C:
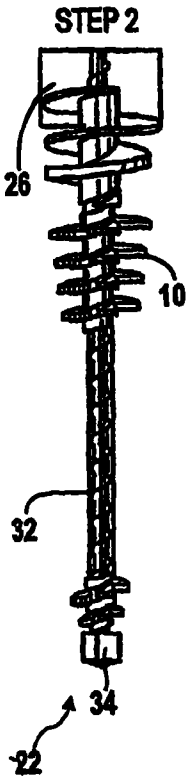
Figure 10D:
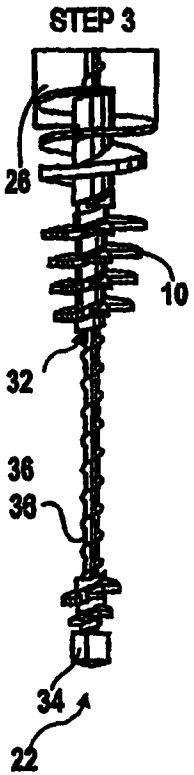
Figure 10E:
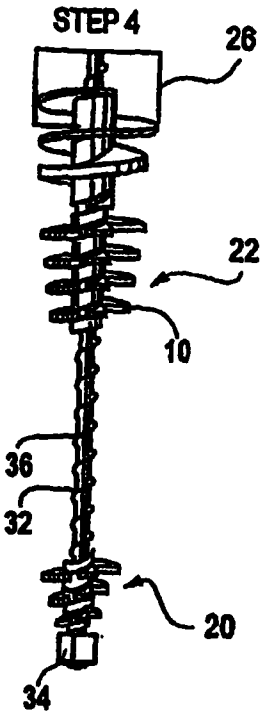

FIGS. 4*a* and 4*b* show edge inserts 11, which can be part of the cutting arms 10 in embodiments of the invention (see FIG. 9). Such edge inserts 11 are typically attached to the arms 10 by brazing. These inserts 11 can provide a superior cutting material than that of unadorned arms 10. The inserts 11 can be, for instance, polycrystalline diamond or carbide. On smaller cutting arms 10, as shown in FIGS. 5*a* and 5*b*, pockets 13 are provided in the bit shaft 12 for brazing the inserts 11 onto the arms 10. In an alternative embodiment, the cutting edge of the cutting arms 10 can be incorporated into the cutting arm 10 without need for an insert. Such is the case when the cutting arms 10 are made of a heat-treated alloy or when they are made for a one-time use, as in the case of self-drilling bolts, for example.

The helical drag bit is used to further cut the sidewalls of a pilot hole to achieve a modified sidewall geometry. The bit excavates the sidewalls of the pilot bore, leaving a relatively well-defined spiral or interlocking cut along the depth of the bored hole. The ultimate depth of the cut into the sidewalls depends on maximum axial cutting arm length 14. During cutting, debris can be removed from the cutting area and "swept" towards the center of the hole by the shape of the arms 10. Cuttings can then be removed from the bore hole in a hydraulic, pneumatic, or hollow-stem auger process. Other embodiments, methods, and systems using the bit are envisioned.

Figure 6:
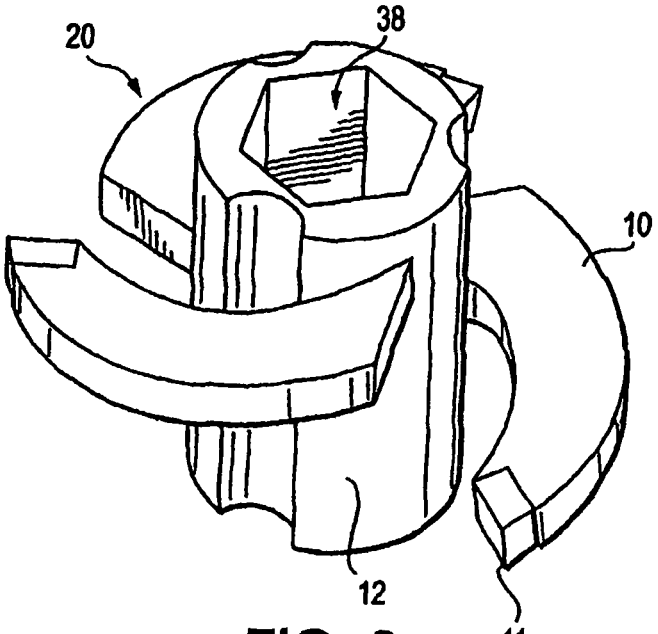
FIG. 6 is a perspective view of a helical drag bit flight portion in accordance with an embodiment of the invention.

FIG. 6 shows a bit flight 20 to be used in latter stages of a bit stack. As shown, the cutting arms 10 of the flight 20 are considerably longer than those shown in FIGS. 1*a* and 2*a*, for example. Also, FIG. 6 shows an embodiment where a distinct cutting arm 10 geometry is used. The cutting arms 10 shown in FIG. 6 also terminate in edge inserts 11, which provide increased cutting capability. FIG. 7 shows a pair of bit flights 20*a* and 20*b* and provides some contrast between an initial flight 20*a*, which has shorter cutting arms 10, and a latter flight 20*b*, which has longer cutting arms 10. FIG. 8 provides additional perspective as to how flights 20 are stacked for a cutting system and shows the difference in lengths between an initial cutting arm 10*a* and a terminating cutting arm 10*b*.

FIG. 9 shows an LRFD system 22 incorporating a helical drag bit in accordance with an embodiment of the invention. The system 22 is comprised mainly of down-hole components including a bit system 24, bailing bucket 26, down-hole electric motor/gearbox 28, debris accumulation cup 30, sheath 32, pilot bit 34, and auger 36. Lifting and lowering of the LRFD in the borehole are accomplished by a tripod frame and winch system on the surface.

As shown in FIGS. 10(*a*) through 10(*e*), comminution of the rock or soil is performed by several helicutter components (e.g., flights 20) that work in series. The individual action of each helicutter relies on the reaction force capability of the remaining stationary helicutters with frictional contact with the rock or soil mass, allowing the system 22 to self-advance, step-by-step, through a broad range of substrate materials. The individual component action also reduces instantaneous power requirements. In FIGS. 10(*a*) through 10(*e*), Step 0 depicts the drill system 22 prior to the beginning of a drilling cycle. Step 1 involves the advancing of the pilot bit 34 into the rock or regolith under the influence of the weight of the drilling system 22 and minimal rotational reaction force.

Still referring to FIGS. 10(*a*) though 10(*e*), a sheath 32 covers the helical auger 36 pilot shaft and permits the conveyance of pilot cuttings to a bailing bucket 26 located above the helicutters system 24. Once extended to maximum reach, shown in Step 1, (can be about 0.3 m in one embodiment of the invention, or less if working in highly fractured rock, rubble or sand) the pilot bit 34 rotates in place to allow the helical auger 36 (inside a sheath 32) along its shaft to transfer cuttings away from the pilot hole area. The sheath 32 then retracts to engage the first helical flight 20. The first helical flight 20 is then rotated and thrust forward in a prescribed ratio by the sheath 32 as shown in Step 2. The flight 20 creates a thread like spiral groove in the pilot hole wall created by the pilot bit 34. In Step 3, the sheath 32 drive tube is retracted from the first flight 20 to engage the second helical flight 20. Step 4 depicts the stage where the second flight 20 reaches its end of stroke. In a consecutive manner, the remaining helical flights 20 are individually advanced to the bottom, deepening the thread groove in the rock.

The purpose of the auger shaft is to drive the pilot bit 34 and convey the rock cutting debris to a bailing bucket container. Table I summarizes cutting properties, in various substrates, of an exemplary embodiment of the invention, as depicted in FIGS. 10(*a*) through 10(*e*).

TABLE I

| Media | State | Density (g/cm^3) | Comments |
|---|---|---|---|
| Limestone | Pulverized | 1.700 | Flowed with some clumping |
| Sandstone | Pulverized | 1.630 | Flowed well |
| Sand | Granular | 1.500 | Flowed with some grinding |

Figure 11:
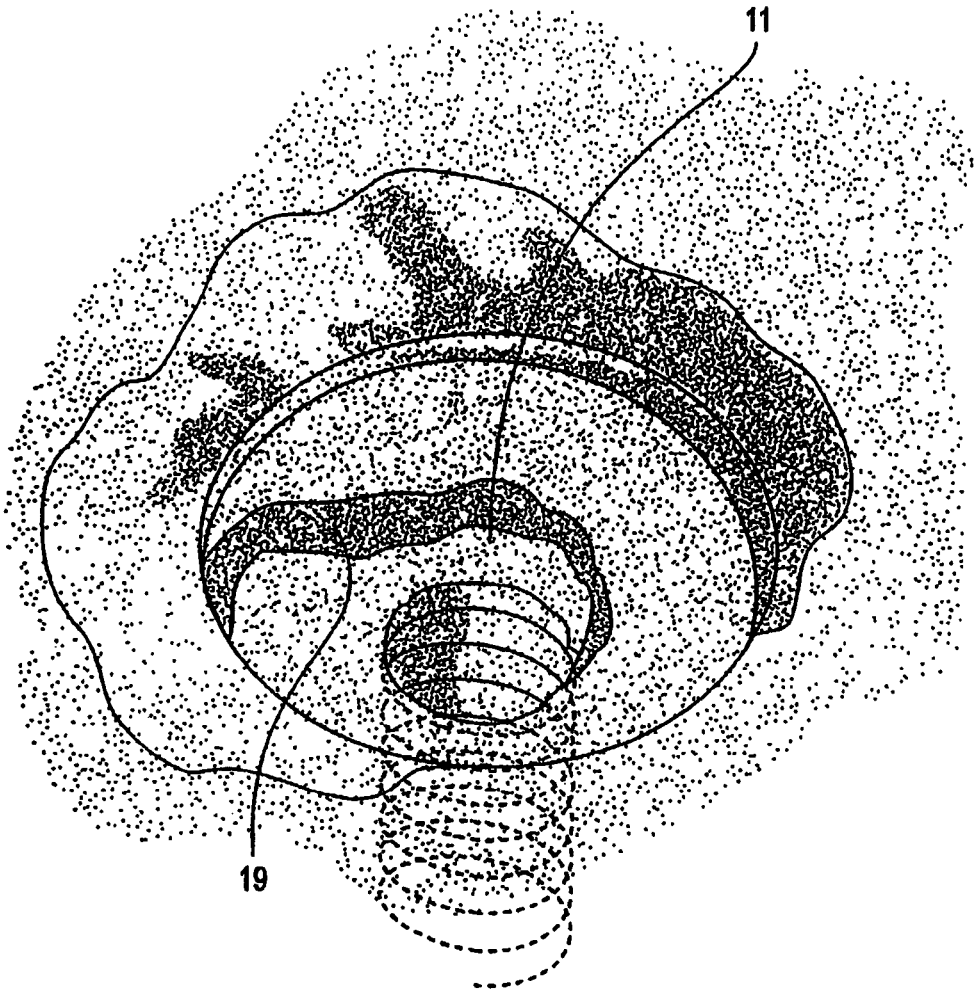
FIG. 11 shows a detailed view of a hole formed by a device in accordance with an embodiment of the invention.

FIG. 11 shows a hole created using a device in accordance with an embodiment of the invention, which comprises helical spiral threads 19 at a specified pitch in rock 11. The helicutters incorporate a basic drag bit approach to shearing a helical groove 19 in the rock 15. Based on the pitch 18 of the helical spiral, a traceable thread groove 19 is created in the rock 15 that allows for development of downhole reaction forces and the extraction of rock samples that have not seen excessive thermal loading. By modifying the pitch 18 of the cutter arms 10, individual cutter arm 10 thickness, rake, and back angle, cutter arm 10 section geometry, and number of cutter arms 10 per flight 20, several drilling parameters can be modified across a broad range. The parameters affected by this include axial force, torque and efficiency for a given RPM.

As shown in FIGS. 1*b*, 2*b*, 3*a*, and 6-8, special attention is given to the internal design of the cutter hub 38. Engagement between a flight 20 and a sheath-driver is made possible through key grooves in the internal surface of the hub 38 and key posts of the sheath-driver. In order to engage a flight 20 to the driving shaft, the driver is threaded into the cutter hub 38. Once the driver reaches the set position inside the hub 38, a cam system is activated by the reverse rotation of the pilot bit 34, lifting the driver to engage its posts into the hub 38 grooves. Engagement between the cutter arm flights 20 and the sheath-driver is designed to smoothly lock and unlock the hub in the cutting mode, while transmitting the cutting torque with a high strength margin.

The average power consumption in drilling a 63 mm diameter hole with 1.89 m of advance through sandstone is about 225 Watt-hrs/m. Power consumption on the order of about 100 Watt-hrs/m is achievable, according to one embodiment of the invention, using the system 22 of the invention. Power consumption in sandstone averages about 385 $MJ/M^3$, while power consumption in limestone averages about 300 $MJ/m^3$.

In one embodiment of the invention, system 22 mass has been shown to be about 45 kg for one prototype that was used in the laboratory. Many of the articles of the system 22 are preferably removable. Taking this into account it has been shown that total system 22 mass can be reduced to about 16 kg, in accordance with an embodiment of the invention.

In accordance with an embodiment of the invention rock chips of greater than 1 $cm^3$ can be recovered from holes with the ability to know the location from which samples were derived to within 15 mm.

Instead of plunging an entire shaft deep into a substrate, an alternative strategy may be considered for an alternative embodiment of the invention using a detached, self-driven underground autonomous tethered drill system 22 like that shown in FIG. 9. In contrast to prior drilling systems and methods, such a system 22 may be lightweight so that it needs only enough power to accomplish the drilling task while propelling itself downward, trailing a thin cable for power and communication. An auxiliary thin wire rope connected to a surface winch may be linked to the system 22 for lifting and clearing of scientific samples and the rest of the drill process cuttings. The elimination of drill-string from the drilling process can dramatically reduce the weight of main system 22 components, along with reduction of power consumption for drilling task. While drill-string systems are limited by the ultimate depth they may achieve, autonomous tethered system 22 may reach almost any desirable destination.

Figure 12:
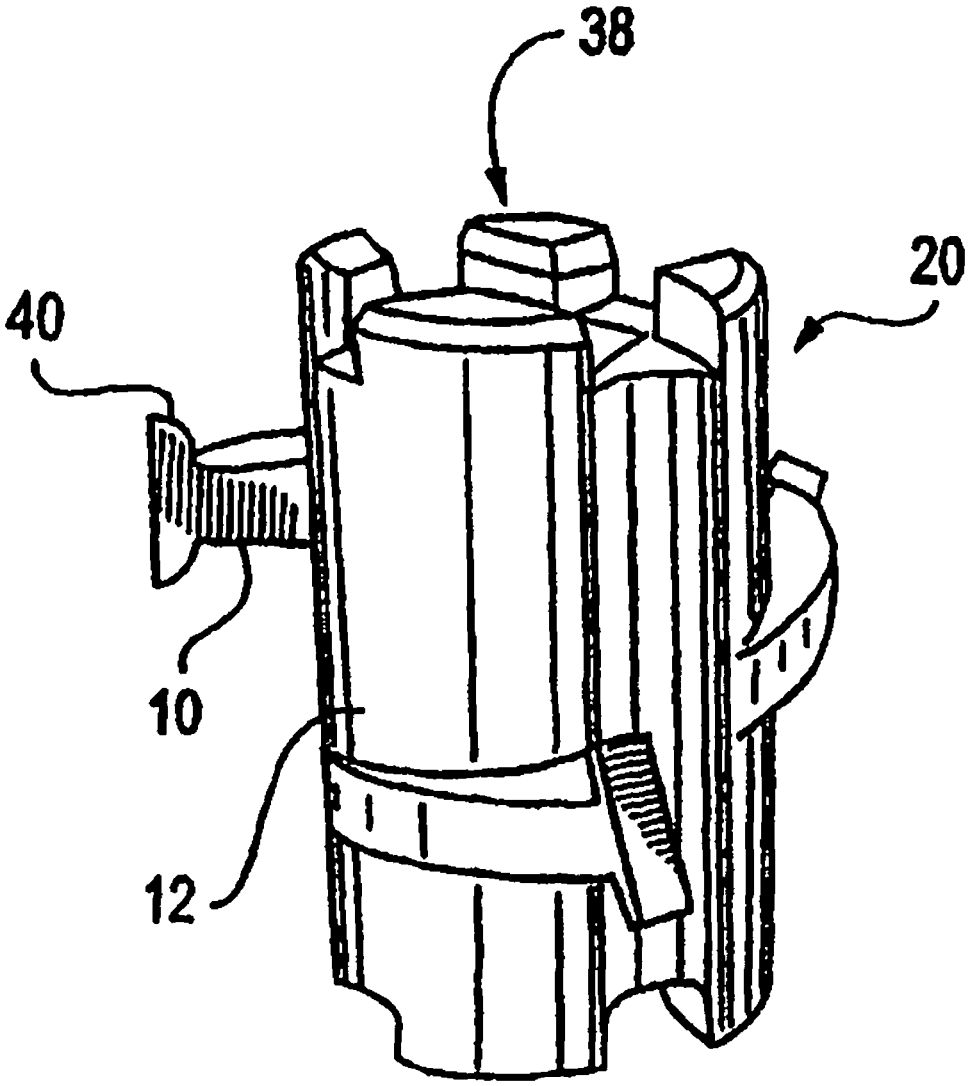
FIG. 12 is a view of two helical drag bit flight portions having scoring cutting arms in accordance with an embodiment of the invention.
Figure 13E:
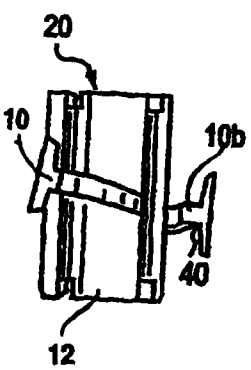
FIGS. 13(*a*) though 13(*e*) show helical drag bit flight portions having scoring cutting arms in accordance with an embodiment of the invention.
Figure 13D:
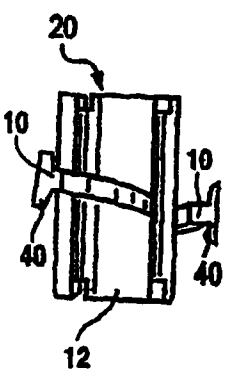
Figure 13C:
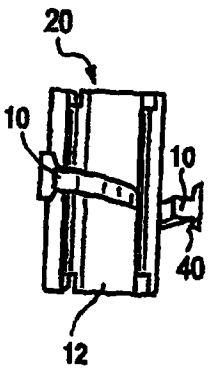
Figure 13B:
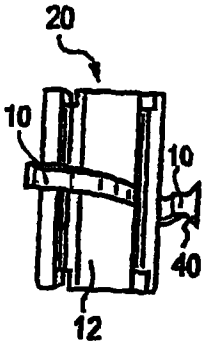
Figure 13A:
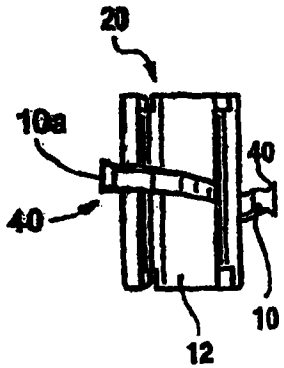

In an alternative embodiment shown in FIGS. 12 and 13(*a*) through 13(*e*), each cutting arm 10 terminates in a scoring cutting blade 40, positioned orthogonally relative to the axial arm length 14, at a tangent to the drag bit body's 12 outer circumference. The scoring cutting blade 40 serves to cut a relatively smooth bore extension to enlarge the hole 17, as opposed to the spiral or interlocking trench 19 formed by the above-described first embodiment. Upon removal, the debris from this second embodiment of the helical drag bit can resemble a coil, spring, or "slinky," or the debris may break-off in pieces for removal.

This embodiment provides a new approach to thread stripping (and thus sample removal). As shown in FIG. 12, cutter flights 20 were fitted with tungsten carbide scoring cutting blades 40 that can cut a kerf in the top and bottom of each rock thread 19 at the deepest point of the helical groove. Successive scoring cutting blades 40, shown in FIGS. 13(*a*) through 13(*e*), cut the kerf deeper and deeper until the whole rock thread 19 is excavated and captured into the bottom of the bailing bucket as a sample The embodiment illustrated in FIGS. 12 and 13(*a*) through 13(*e*) achieves a low-energy drilling bit and provides a superior device for enlarging a pilot hole 17. The bore extension cut with the invention does not require the "snapping-off" of the spiral cut as does the device of the '027 patent. This embodiment can be utilized with the system 22 of FIG. 9, where thread scorers 40 are advanced breaking off the rock ridges as scientific samples. For a final hole diameter of about 80 mm (practical range of finished hole diameter can be 50 mm to 250 mm) the chips formed by thread breaking can be about 2 to 3 cm in length. Chips can be captured in a bailing bucket 26 along with pilot cuttings from the pilot auger shaft that can be captured in a separate bailing bucket compartment. Following a complete drilling cycle the bucket can then be lifted to the surface by a winch wire-line system.

The helical drag bit may be used as a geo-tech device for measuring the properties of drilled substrates 15 (e.g., rock), like that shown in FIG. 11, by measuring the torque required to advance the helicutter. Such an embodiment of the invention has the advantages of enabling in situ, direct rock compression strength measurements to be made in the field during drilling and also of eliminating the bounce anomaly associated with prior art compressive strength testing techniques, thereby providing on-the-spot, reliable geo-tech measurements.

The compressive strength of rock substrate 15 through which the helical drag bit is traveling is measured, in part, based on (i) the cutting arm 10 design of the helical bit and (ii) torque required to turn the helical bit through the rock 15. Although each successive arm 10 can have an increasingly larger axial length 14, the cutting depth generally is the same for each, and the average cutting depth of all arms 10 can be used for measurement calculations. The torque on the helical drag bit and each arm 10 is a known variable, which can be controlled or measured.

As shown in FIG. 9, the drill system 22 incorporating the helical bit can be in communication with a computer 42 or other device having software for calculating the compressive strength of the rock 15 based, in part, on the helical drag bit design and the torque on the drill. The bounce anomaly is corrected because the helical drag bit is designed to have opposing arms 10. Because the arms 10 of the helical drag bit are always in opposition during use and have increasing lengths, there is no opportunity for bounce and the arms 10 are always cutting, making for balanced forces on the helical bit.

The geometry of a helical flight 20 provides symmetry of forces such that the normal force on each cutter is balanced by the cutter arm 10 on the opposite side of the flight 20. Every rotation of the helical flight 20 results in a prescribed advance into the rock 15 and the cutting depth is defined by the initial hole 17 diameter, the pitch 18 of the cutter arms 10 surrounding the central hub 38 and the geometry of the individual cutter arms 10. Ultimately the system 22 can interpret lithologic changes based on measuring torque. Drilling in three different lithologies and across small bed separations has shown a direct correlation between measured torque and the compressive strength of the rock 15 via the following equation:

$$q_u = \frac{Tc}{K_{SE} \cdot w \cdot d \cdot r}$$

In the above equation: $q_u$ is the unconfined compressive strength of the substrate; Tc is the torque per cutter; $K_{SE}$ is a coefficient of proportionality between specific energy (SE; $SE=K_{SE} \cdot q_u$) and the unconfined compressive strength ($q_u$) of the substrate; w is the cutter width; d is the depth of the cut; and r is the radial distance of the cutting edge (measured from the center of rotation).

In accordance with an embodiment of the invention, the helical drag bit is used as a geo-tech device in a similar manner as discussed above in relation to the system 22 shown in FIG. 9. A pilot hole 17 is bored in a substrate 15 to fit the body 12 of the helical drag bit. Then the helical drag bit can be used for geo-tech measurements by spirally cutting the sidewalls of the pilot hole 17 while the forces acting on the helical bit are measured to calculate substrate properties.

Another embodiment of the invention uses the helical drag bit in the mining and excavating industries, as well as in any scenario where a particulate substrate 50 (e.g., rock or concrete) requires support and stability control. In mines, for example, it is required that an underground opening be reinforced with a supporting/stabilizing rock bolt 52. The invention can be used to achieve at least a 40% increase in holding capacity and pull-out strength for rock bolts 52 within rock 50. Additionally, use of the helical drag bit system in forming rock bolt holes reduces the dust and noise compared to prior methods. The helical drag bit system produces relatively large rock chips instead of small particles, which reduces dust formation. Also the helical drag bit system operates at a relatively low rpm, which reduces drilling vibrations and thereby noise.

Figure 14:
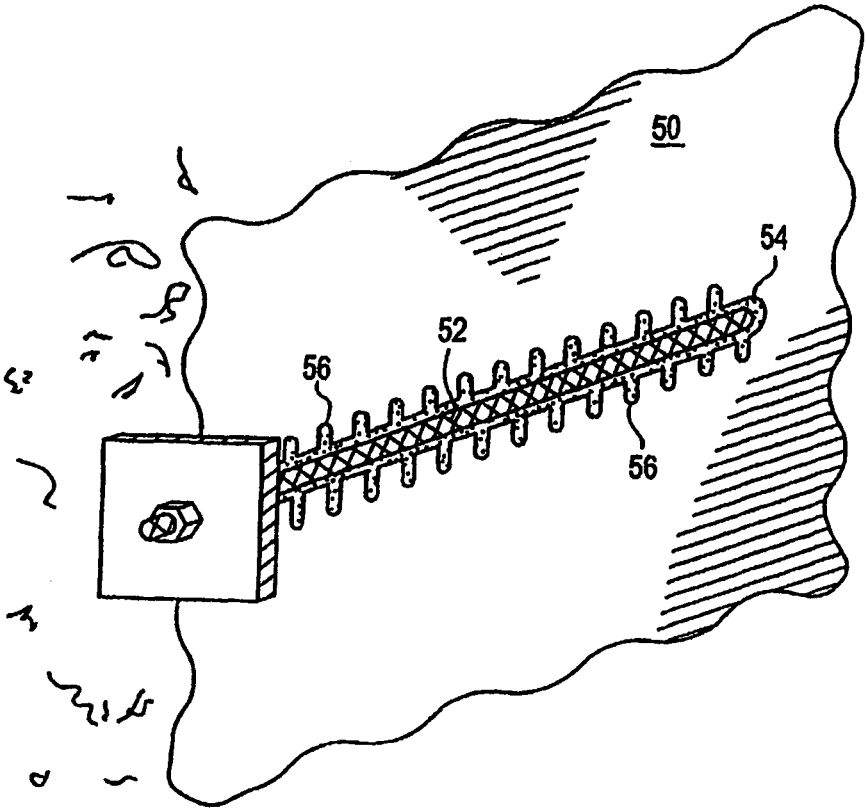
FIGS. 14-16 are cross-section views of a substrate and a rock bolt in accordance with exemplary embodiments of the invention.

As shown in FIG. 14, after boring a relatively smooth pilot hole 54, the helical drag bit can be used to spirally (or helically) cut the interior sidewall of the hole in an "optimal hole geometry" 56, thereby texturizing the hole 54 in a manner like that shown in FIG. 11. The texturized hole 54 allows resin to spread over a greater surface area inside the hole 54 with a complex (spiral or interlocking) geometry, and thereby achieve a better grip between the rock 50 and bolt 52.

The optimized hole geometry can be configured to the physical and chemical properties of the resin/grout and surrounding rock and rock strata. The optimal hole geometry can modify the mechanism of the pullout force transfer between the grout and rock. In accordance with this embodiment of the invention, it is possible to form right or left handed grooves in the optimal hole geometry. For example, left handed grooves used with a right handed rock bolt rotation can improve resin/grout redistribution.

This technique is not limited to providing supporting and stabilizing means for the roof walls of mine openings. The technique can be used in a variety of particulate substrates in a variety of orientations where a bolt-like device would be advantageous. For instance, the helical drag bit can be used to form bolt holes 54 in retaining walls or in concrete surfaces, and in both vertical and horizontal orientations.

An embodiment of the invention incorporates use of a rock bolt 52 to complement the superior hole geometry characteristics achieved with the helical drag bit of the invention. Such a bolt 52, however, is not limited to use in a rock 50 substrate and is not limited to a particular size. The bolt 52 can be used in any particulate substrate and can range in length from mere centimeters to meters.

Figure 15:
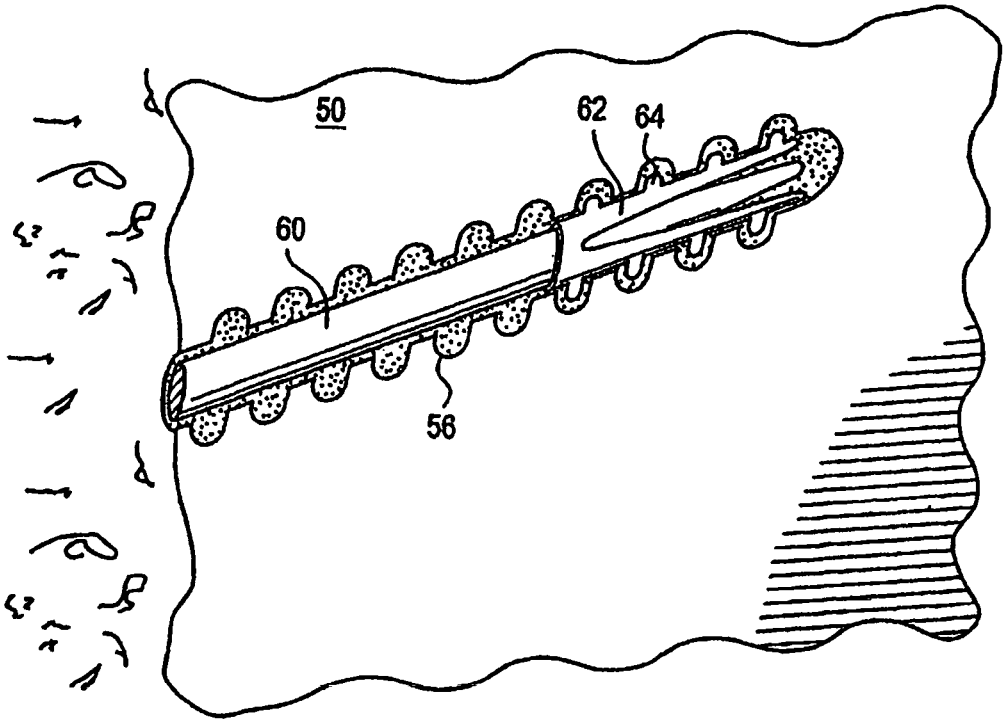

In one embodiment, shown in FIG. 15, the rock bolt 60 can have a mechanical anchor 62 at the end of the bolt 60. The anchor 62 will engage the helical threads 64 located at the end of the associated pilot hole. The mechanical anchor 62 adds another level of holding capacity and pull-out strength to the bolt 60, thereby providing additional safety. The bolt 60 with the mechanical anchor 62 can be used with or without resin. This is not a self-drilling bolt embodiment.

In another embodiment, the bolt (e.g., bolt 52 of FIG. 14) is self-drilling. The helical cutter will be incorporated into the bolt itself. The bolt can screw itself into rock 50 with or without the need of a well-defined pilot hole. The self-drilling bolt can be used with or without (if no pilot hole is used) resin, depending on the depth of the grooves 19 of the optimal hole geometry.

Figure 16:
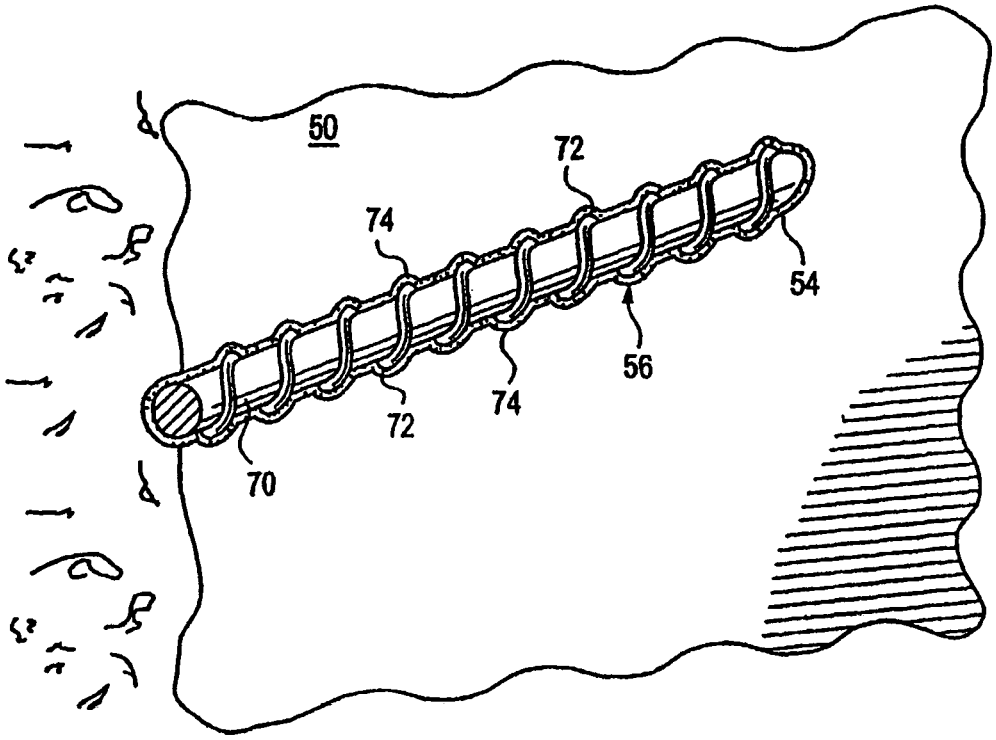

In another embodiment, shown in FIG. 16, the rock bolt 70 is itself a helical anchor, being either fully threaded or partially threaded. The helical anchor bolt 70 has threads 72 that can loosely or tightly match the spiral cuts 74 made by the helical drag bit. In this embodiment, a threaded portion of the rock bolt 70 fits into the spiral cut portions 74 of the hole 54 in the rock 50. This bolt embodiment gains added holding strength and pull-out capacity by allowing the rock 50 itself to directly support the bolt 70. Again, such a bolt 70 could be used with or without resin. Additionally, this embodiment is particularly useful for concrete support and stabilization. The rock bolt 70 can also be configured relative to the optimized hole geometry 56 so as to be removable and reinsertable upon demand. A fully threaded bolt 70 will have maximum anchorage capacity. A partially threaded bolt 70 can serve to reduce roof layer separation by anchoring to the most competent portion of substrate.

Figure 18:
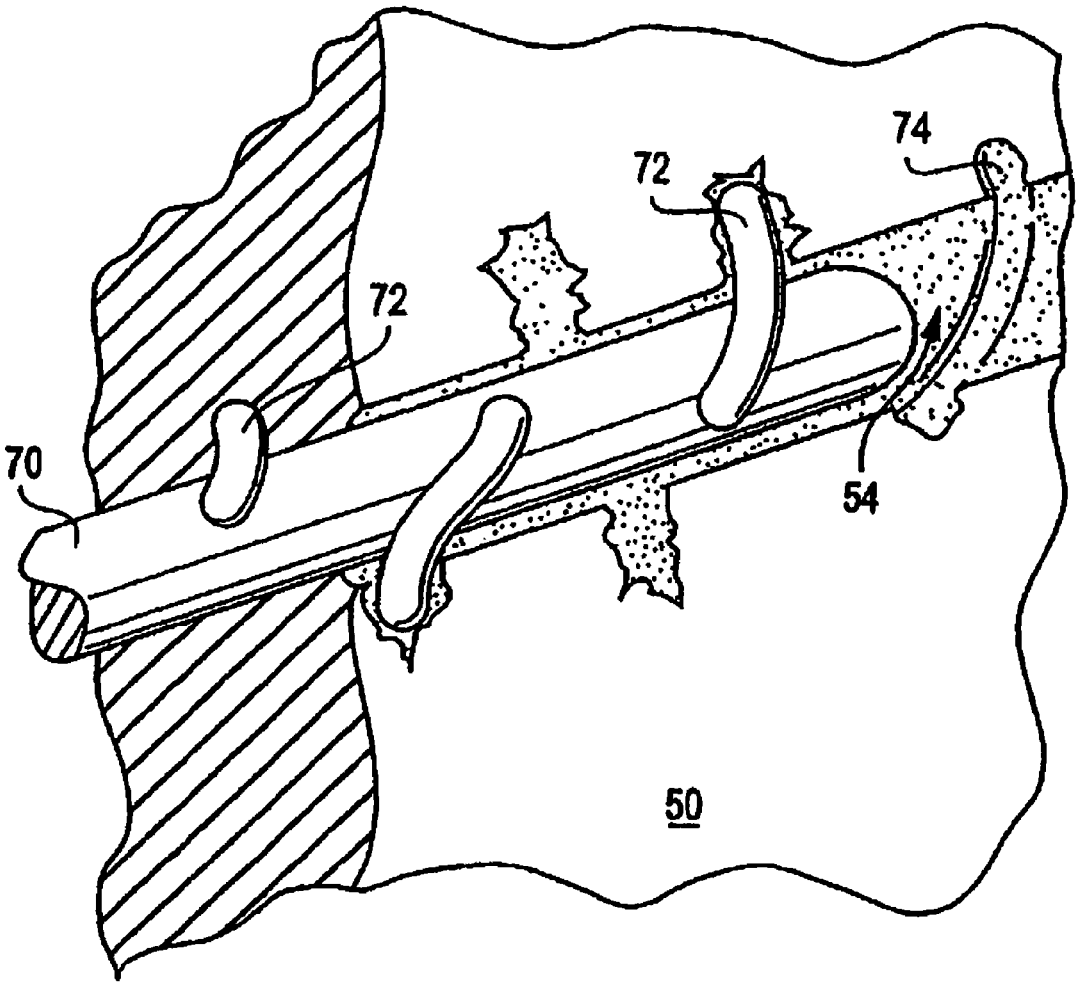
FIG. 18 shows a cross-section view of a substrate and a rock bolt in accordance with an exemplary embodiment of the invention.

FIG. 18 shows an embodiment similar to that shown in FIG. 16. The rock bolt 70 of FIG. 18 has partial threads 72, which in this embodiment refers to the non-continuous design of the threads 72. The helical groove 74 cut into the rock bolt hole 54 using the helical drag bit system can be slightly smaller than the threads 72 of the rock bolt 70. Such a design promotes the further cutting of the rock 50 by the threads 72 of the rock bolt 70, which is facilitated by the prior cutting of the groove 74 by the helical drag bit system. The threads 74 provide additional holding capacity for the rock bolt 70. Grout, or another adhesive, may be used with this embodiment and the additional cutting of the rock 50 by the rock bolt threads 72 effectively spreads the grout throughout the hole 54.

As discussed above in reference to FIG. 14, the pitch of the helical drag bit and the cross-section of the individual cutters can be optimized in view of the properties of the surrounding rock 50 and of the resin grout is used. The ultimate displacement of the rock bolt 52 before pullout occurs can be controlled by the pitch of the grooves 56. The force transfer mechanism between the grout and the rock 50, as well as the bolt 52 and the rock 50, can be controlled by the changes in the cross-section of the grooves 56 of the optimal hole geometry. The pitch may be adjusted in real time to suit the rock properties as measured in situ during the advancement of the helicutters.

Figure 19A:
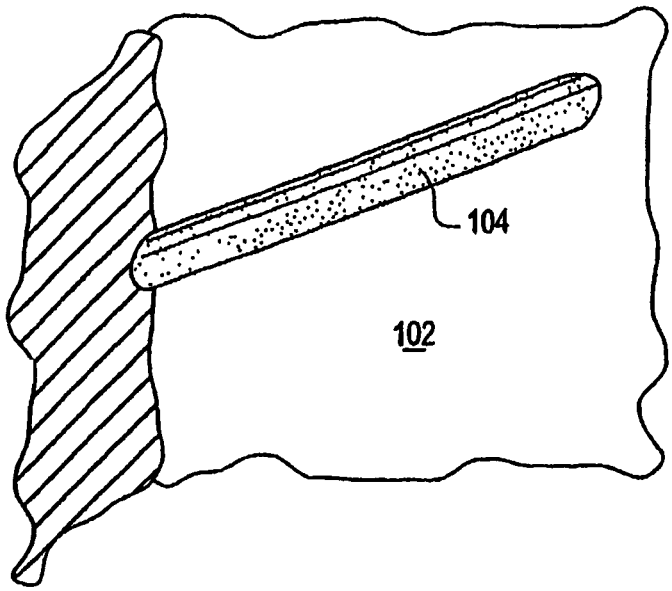
FIGS. 19*a*-19*d* show a cross-section view of a substrate and a rock bolt in accordance with an exemplary embodiment of the invention.
Figure 19B:
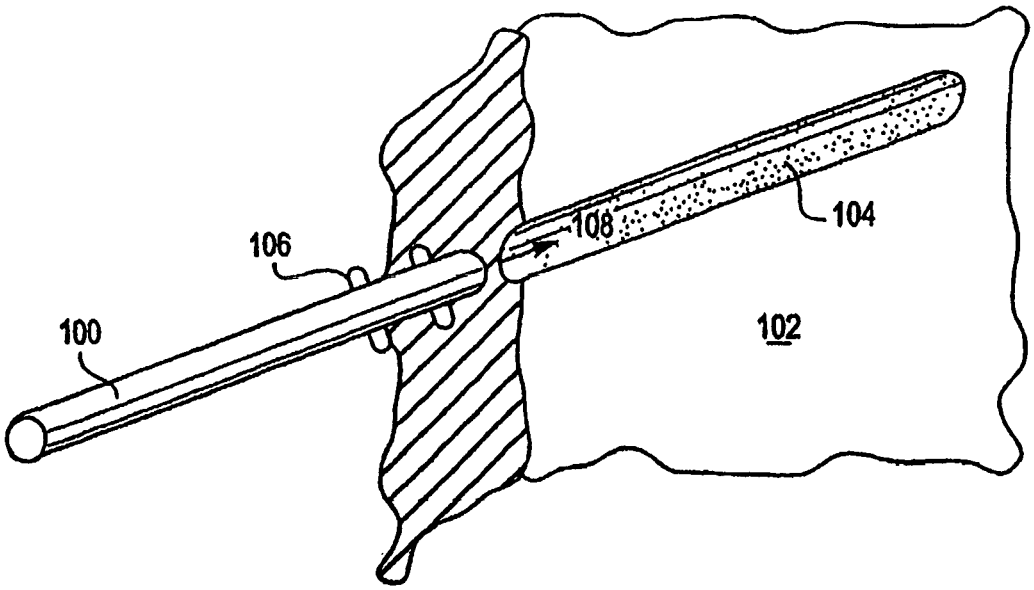
Figure 19C:
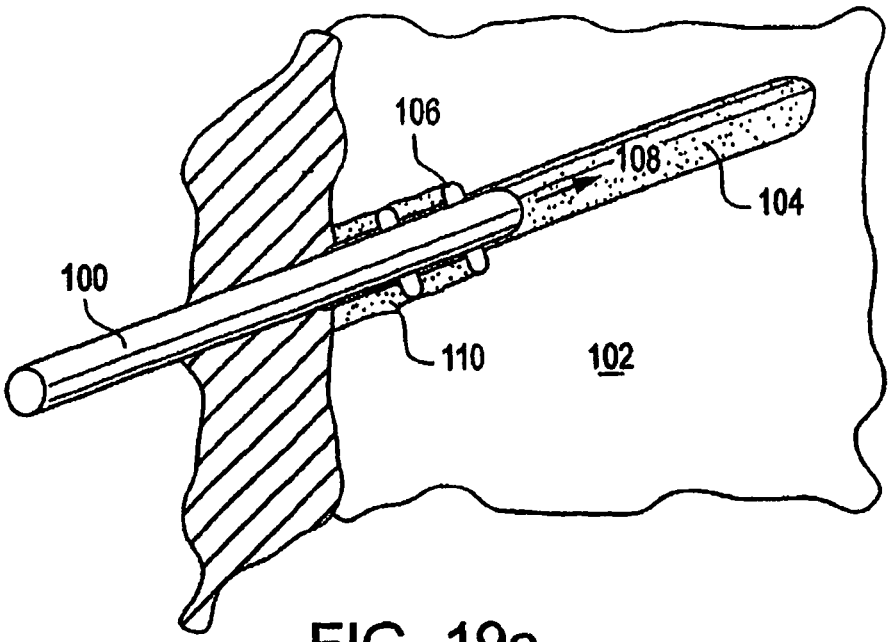
Figure 19D:
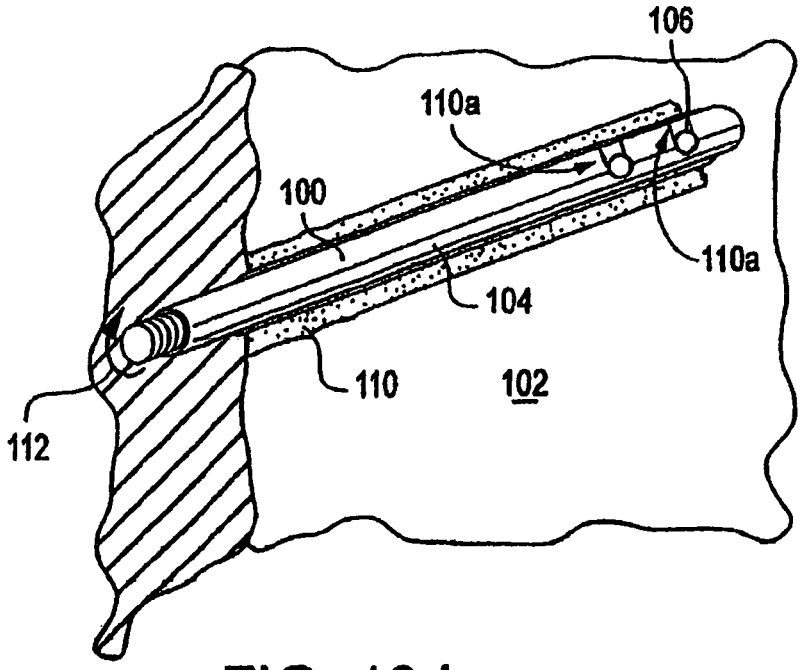
Figure 20A:
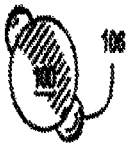
FIGS. 20*a*-20*f* show exemplary embodiments of rock bolts in accordance with the invention.
Figure 20C:
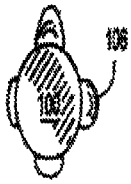

Another embodiment of the invention is shown in FIGS. 19*a*-19*d*. FIG. 19*a* shows a cross-section of rock 102 having a rock bolt hole 104 formed therein. In this embodiment, the helical drag bit system is not necessarily used since the rock bolt 100 itself has the capability of forming a groove for holding itself in the hole 104. FIG. 19*b* shows a rock bolt 100 having protuberances 106 along at least a portion of its length, preferably at the tip end which will ultimately be positioned nearest the end of the rock bolt hole 104. These protuberances 106 are not mere irregularities or deformities in the rock bolt 100 such as may be found in typical rebar, for example, but are designed to excavate the rock 102 around the rock bolt hole 104. The rock bolt 100 is moved into the rock bolt hole 104 in a direction 108. As shown in FIG. 19*c*, as the rock bolt 100 is forced into the hole 104, the protuberances 106 will gouge or cut the wall of the rock bolt hole 104, producing a rough groove 110 along the hole 104. FIGS. 19*c* and 19*d* show the groove 110 in a direction along the plane of the drawing; however, the groove 110 will preferably enlarge the hole 104 only with respect to the size of the protuberances 106, which are preferably isolated and discrete along the shaft of the rock bolt 100 (FIGS. 20*a*-20*c*). Upon complete insertion of the rock bolt 100 into the rock bolt hole 104, the rock bolt is partially rotated 112 so that groove 110*a* is formed semi-annularly with respect to the rotation, the rock bolt 100, and the rock bolt hole 104. This groove 110*a* provides support for the protuberances 106, which locks the bolt 100 into the hole 104.

Figure 19E:
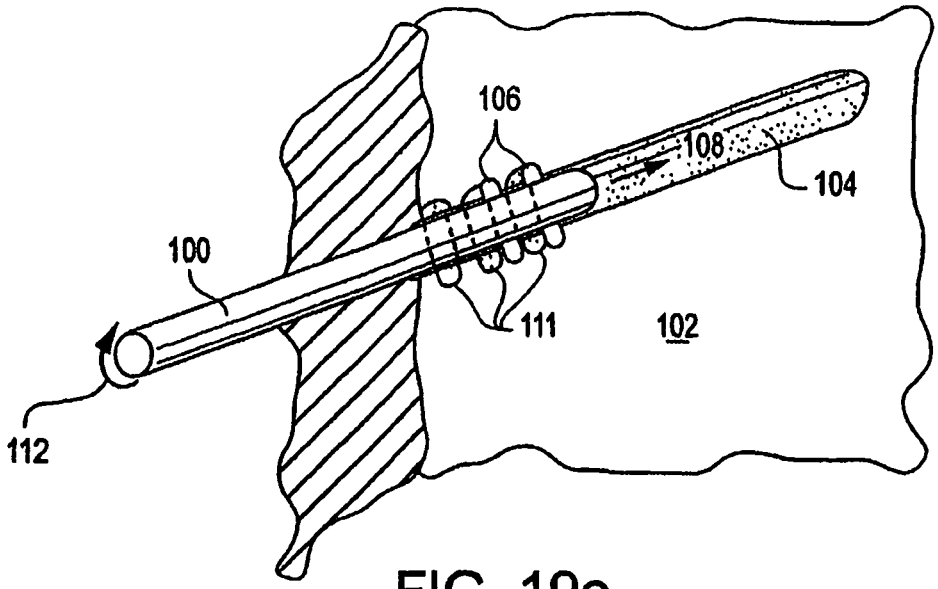
FIGS. 19*e* and 19*f* show a cross-section view of a substrate and a rock bolt in accordance with an exemplary embodiment of the invention.
Figure 19F:
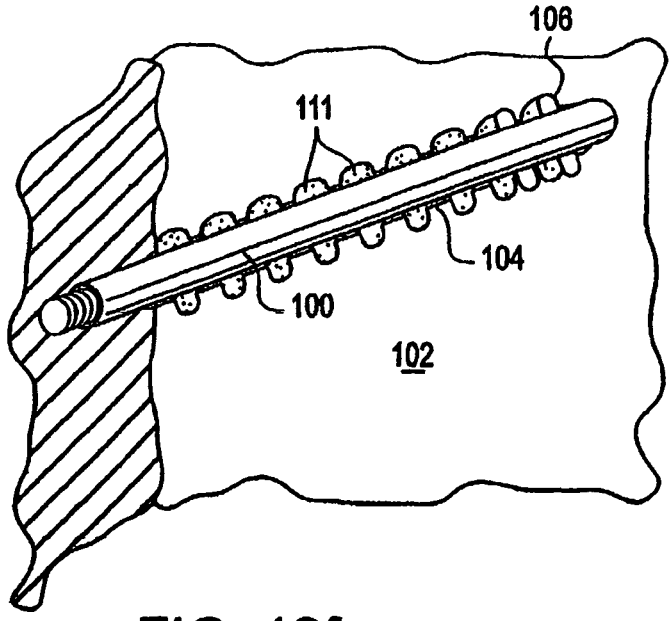

FIG. 19*e* shows an alternative embodiment, where a rock bolt 100 of the same basic configuration as shown in FIGS. 19*c* and 19*d* is inserted into a rock bolt hole 104, but instead of being forced straight into the hole 104, the bolt is rotated 112 while being forced into the hole 104 in the direction 108. This rotation 112 and forward motion 108 of the bolt 100 and protuberances 106 creates a spiral-type groove 111 along the wall of the rock bolt hole 104. The rotation 112 may be continued throughout insertion of the rock bolt 100 to create a groove 111 as shown in FIG. 19*f*. This spiral groove 111 will support the protuberances 106 and will hold the rock bolt 100 in the rock bolt hole 104, particularly if grout is used.

Figure 20E:
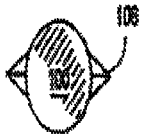
Figure 20B:
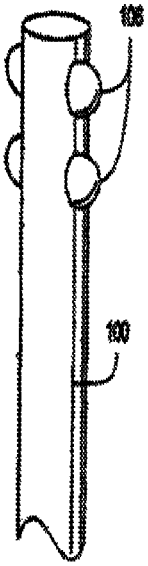
Figure 20D:
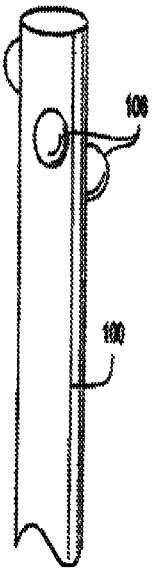
Figure 20F:
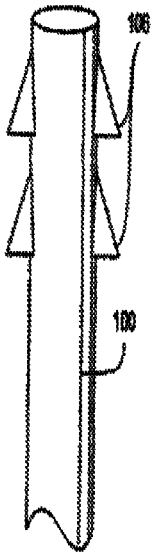

The protuberances 106 of the rock bolt 100 shown in FIGS. 19*a*-19*f* can be of several designs, including but not limited to those shown in FIGS. 20*a*-20*f*. FIGS. 20*a* and 20*b* shows a rock bolt 100 having rounded protuberances, similar to those as shown in FIGS. 19*a*-19*f*. FIGS. 20*c* and 20*d* shows a rock bolt 100 having rounded protuberances 106 that increase in radial length from a first protuberance 106 toward the tip end 114 the rock bolt onward. This configuration allows for easier gouging/cutting of the grooves 110 or 111 shown in FIGS. 19*c*-19*f*. FIGS. 20*e* and 20*f* shows a rock bolt 100 having angular protuberances 106, which may be in the form of blades or may be pyramid-shaped. This angular shape of the protuberances 106 allows for easier insertion into and gouging/cutting of the rock bolt hole. As stated above, other protuberance 106 shapes and configurations are possible.

Protuberances 106 may be formed in a number of ways, including, but not limited to, formation during stamping of a rock bolt as a part thereof. Protuberances 106 may also be formed by attaching them to a rock bolt by brazing or welding. Additionally, recesses or holes may be formed in a rock bolt for insertion of protuberance 106 there into. As stated above, other ways of forming the protuberances 106 are possible.

Figure 17:
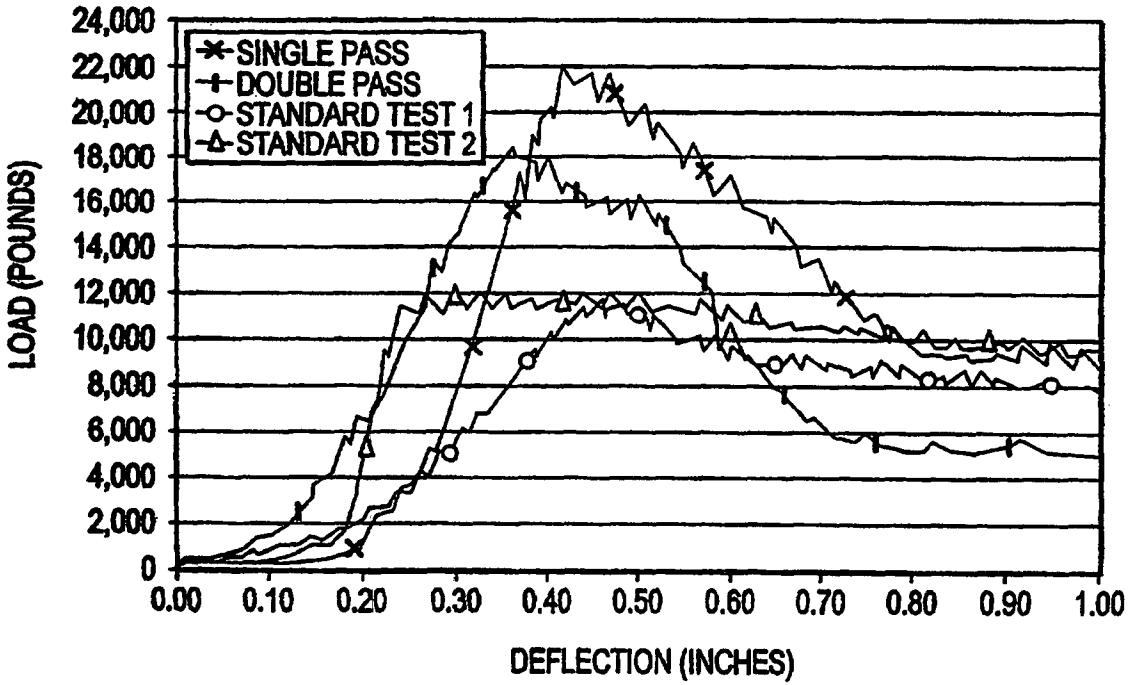
FIG. 17 is a graph comparing the pullout strength of a conventional rock bolt used in a prior art rock bolt hole with that of a conventional rock bolt used in combination with a rock bolt hole formed in accordance with an embodiment of the invention.

FIG. 17 shows a graph, which compares rock bolt pullout strength using prior art hole geometries (i.e., standard tests 1 and 2) to rock bolt pullout strength using an optimized hole geometry (i.e., single and double passes) in accordance with an embodiment of the invention. Tests were performed in the same rock material. The graph plots the load in pounds force required to pull a rock bolt along its axis to a given displacement. As shown in the graph, rock bolts used in combination with the optimal hole geometry show improved bolt pullout performance.

Embodiments of the invention can also be used to reduce dust and noise when drilling rock bolt holes 54. Cutter arm 10 depth can be carefully designed to reduce torque requirements per cutter arm 10 or by increasing depth, to increase the size of chips. In one study, all drilling cuttings were collected from two different helical cutter flights 20. The cuttings were sieved to separate fines from larger chips using a 0.015 mesh. With a change of only 0.05 inch cutter arm 10 depth, significant differences in drill cuttings characteristics were identified with no detrimental effect on drilling. Table II illustrates the differences in the cuttings characteristics.

TABLE II

| | Flight 1 | Flight 2 |
|---|---|---|
| Avg. Torque | 55 N-m | 41 N-m |
| Thread cuttings mass for 2.85 m of drilling | 204 gm | 146.4 gm |
| Mass of particles <0.015 mesh | 153 gm | 127.6 gm |
| Mass of particles >0.015 mesh | 51 gm | 18.8 gm |

The processes and devices described above illustrate preferred methods and typical devices of the invention; however, other embodiments within the scope of the invention are possible. The above description and drawings illustrate embodiments, which achieve the objects, features, and advantages of the present invention. However, it is not intended that the present invention be strictly limited to the above-described and illustrated embodiments. Any modifications, though presently unforeseeable, of the present invention that comes within the spirit and scope of the following claims should be considered part of the present invention.

What is claimed as new and desired to be protected by Letters Patent of the United States is:

1. A method of supporting a substrate, said method comprising the steps of:

providing a hole, having a wall, in said substrate;

subsequently, inserting a rock bolt into said hole in said substrate, and using said rock bolt to form a groove in said wall of said hole when said rock bolt is inserted therein;

providing a grout anchor in said hole; and causing said rock bolt and said anchor to interact with said groove, such that said rock bolt is secured in said hole at least in part by said interaction, to thereby support said substrate, wherein the inserting of said rock bolt into said hole comprises continuously rotating said rock bolt.

2. The method of claim 1, wherein said step of forming said groove comprises the step of rotating said rock bolt.

3. The method of claim 1, wherein at least a portion of said groove is semi-annularly shaped.

4. The method of claim 1, wherein at least a portion of said groove is spirally shaped.

5. The method of claim 1, further comprising the step of providing a plurality of protuberances of said rock bolt.

6. The method of claim 5, wherein said plurality of protuberances are all the same size.

7. The method of claim 5, wherein each protuberance has an increased radial length relative to any protuberance closer to a tip end of said rock bolt.

8. The method of claim 5, wherein said plurality of protuberances are rounded.

9. The method of claim 5, wherein said plurality of protuberances are partial threads.

10. The method of claim 5, wherein said plurality of protuberances are angular.

11. The method of claim 10, wherein said plurality of protuberances are pyramid shaped.

12. The method of claim 10, wherein said plurality of protuberances are blade shaped.

13. The method of claim 5, wherein said plurality of protuberances are provided only at an end portion of said rock bolt.

14. The method of claim 5, wherein said plurality of protuberances are provided along the entire length of said rock bolt.

15. The method of claim 1, further comprising rotating said rock bolt after fully inserting said rock bolt into said hole, such that said step of rotating said rock bolt occurs subsequent to said step of providing said hole, having said wall, in said substrate.

16. A method of supporting a rock substrate, said method comprising the steps of: providing a hole, having a wall, in said substrate, inserting a rock bolt having a plurality of protuberances into said hole in said rock substrate, and using said plurality of protuberances to form a plurality of grooves in said wall of said hole when said rock bolt is inserted therein, and wherein said step of inserting said rock bolt into said hole occurs subsequent to said step of providing said hole, wherein said rock bolt is rotated while being inserted into said hole.

17. The method of claim 16, further comprising:

providing a grout anchor in said hole; and causing said plurality of protuberances and said anchor to interact with said plurality of grooves, such that said rock bolt is secured in said hole at least in part by said interaction.

18. The method of claim 16, wherein said rock bolt is rotated after being inserted into said hole.

19. The method of claim 16, wherein at least a portion of said groove is semi-annularly shaped.

20. The method of claim 16, wherein at least a portion of said groove is spirally shaped.

21. The method of claim 16, wherein said plurality of protuberances have a shape selected from the group consisting of rounded, angular, and partial threads.

* * * * *